US009908211B2

(12) United States Patent
Olberg et al.

(10) Patent No.: US 9,908,211 B2
(45) Date of Patent: Mar. 6, 2018

(54) TOOL SUPPORT

(71) Applicant: The Boeing Company, Seal Beach, CA (US)

(72) Inventors: Jeffrey H Olberg, Federal Way, WA (US); Mike M Moodi, Bothell, WA (US)

(73) Assignee: THE BOEING COMPANY, Chicago, IL (US)

( * ) Notice: Subject to any disclaimer, the term of this patent is extended or adjusted under 35 U.S.C. 154(b) by 113 days.

(21) Appl. No.: 14/020,344

(22) Filed: Sep. 6, 2013

(65) Prior Publication Data

US 2015/0072596 A1 Mar. 12, 2015

(51) Int. Cl.
*B24B 23/00* (2006.01)

(52) U.S. Cl.
CPC ..... *B24B 23/005* (2013.01)

(58) Field of Classification Search
CPC ..... B24B 23/02
USPC ..... 451/358, 359, 360
See application file for complete search history.

(56) References Cited

U.S. PATENT DOCUMENTS 4,590,713 A * 5/1986 Yasui ..... B24B 23/005 15/246
5,947,805 A 9/1999 Van Osenbruggen
6,280,309 B1 8/2001 Van Osenbruggen
6,425,813 B1 * 7/2002 Ernst ..... B24B 7/186 451/350
8,075,374 B2 * 12/2011 Wall et al. ..... 451/355
2002/0132570 A1 * 9/2002 Berg ..... B24B 23/005 451/344
2006/0128287 A1 * 6/2006 Coe ..... 451/361
2006/0211348 A1 * 9/2006 Hyde et al. ..... 451/367
2006/0230623 A1 * 10/2006 Ziegs et al. ..... 30/392
2008/0233847 A1 * 9/2008 von Siegroth et al. ..... 451/344

OTHER PUBLICATIONS

Eisenblatter GmbH; "POLY-PTX special bar handle;" downloaded May 3, 2013 from http://www.eisenblaetter.de/eng/products/poly-ptx_800/accessorie_tools.html.

* cited by examiner

*Primary Examiner* — Monica Carter
*Assistant Examiner* — Lauren Baronja
(74) *Attorney, Agent, or Firm* — Parsons Behle & Latimer

(57) ABSTRACT

A support accessory is disclosed for a hand tool, such as a grinder or polisher. The support accessory is configured to be detachably fastened to the hand tool. The support accessory includes a frame with a longitudinal beam configured to stabilize the hand tool front-to-back when the hand tool is fastened to the support accessory, as well as a trunnion rotatably coupled to the frame and configured to stabilize the hand tool side-to-side when the hand tool is fastened to the support accessory. The support accessory is also configured to support the hand tool in a position that is substantially parallel to a surface of a workpiece during use.

20 Claims, 3 Drawing Sheets

TOOL SUPPORT

FIELD OF THE DISCLOSURE

The present application relates generally to accessories for hand tools, such as grinders and polishers.

BACKGROUND

Power hand tools, such as grinders and polishers, are used in a wide variety of manufacturing environments, including in the aerospace and automotive industries, for example. Certain hand tools can be quite heavy and cumbersome. Even so, in some cases, a tool operator may be required to hold and maneuver the tool in a particular position or orientation with respect to a workpiece for an extended period of time, such as an 8-hour work shift. In such cases, the tool operator may experience fatigue, strain, or even injury over time.

In addition, in some cases, an operator may simply be incapable of supporting the weight of a tool for an extended time period. In such cases, the tool or a portion of it may become misaligned or unbalanced, which may cause damage to the tool and/or the workpiece. To provide an example, a hand grinder tool may include a head with a rotating brush that is intended to remain parallel to the surface of a workpiece. If the operator struggles to support the weight of the tool, the head may tilt over time, making it difficult to grind the surface of the workpiece as desired, particularly if it is contoured. In addition, the tilting of the tool head may cause uneven wear of the rotating brush, which may in turn require more frequent brush replacement, costing time and money.

SUMMARY

The present application discloses a support accessory that advantageously makes it possible for an operator to set a hand tool on a workpiece and simply guide the tool over the workpiece without having to struggle to hold the tool level and off surface.

In one example, a support accessory is configured to be detachably fastened to a hand tool. The support accessory comprises a frame with a longitudinal beam configured to stabilize the hand tool front-to-back when the hand tool is fastened to the support accessory, and a trunnion rotatably coupled to the frame and configured to stabilize the hand tool side-to-side when the hand tool is fastened to the support accessory. The support accessory is configured to support the hand tool in a position that is substantially parallel to a surface of a workpiece.

The hand tool may comprise a grinder or polisher. The support accessory may further comprise a front foot in a housing detachably coupled to the frame, and two or more back feet detachably coupled to the trunnion. The front foot may be laterally offset from the longitudinal beam. The front foot may include a height adjustment device. The front foot and back feet may each comprise a removable nylon ball or a low-friction pad. The support accessory may further comprise a base sleeve configured to wrap around a base of the hand tool. The base sleeve may be configured to enable access for removal and replacement of a tool battery, without detaching the hand tool from the support accessory. The frame may include an opening through which the support accessory may be attached to the hand tool by a fastener. The frame may comprise glass-filled nylon. The trunnion may be configured to rotate about 5-10 degrees with respect to the frame.

In another example, a system comprises a hand tool and a support accessory detachably fastened to the hand tool. The support accessory comprises a frame with a longitudinal beam configured to stabilize the hand tool front-to-back, and a trunnion rotatably coupled to the frame and configured to stabilize the hand tool side-to-side. The support accessory is configured to support the hand tool in a position that is substantially parallel to a surface of a workpiece.

The hand tool may comprise a grinder or polisher. The support accessory may further comprise a front foot in a housing detachably coupled to the frame, and two or more back feet detachably coupled to the trunnion. The support accessory may further comprise a base sleeve configured to wrap around a base of the hand tool. The frame may include an opening through which the support accessory may be attached to the hand tool by a fastener. The trunnion may be configured to rotate about 5-10 degrees with respect to the frame.

In another example, a method is disclosed for using a hand tool detachably fastened to a support accessory comprising a frame and a trunnion rotatably coupled to the frame. The method comprises placing the hand tool and the support accessory on the surface of a workpiece, and guiding the hand tool over the surface of the workpiece, while the hand tool is stabilized front-to-back and side-to-side by the support accessory and is supported in a position that is substantially parallel to the surface of the workpiece.

The hand tool may comprise a grinder or polisher. The surface of the workpiece may be contoured or irregular.

BRIEF DESCRIPTION OF THE DRAWINGS

Like reference numbers and designations in the various drawings indicate like elements.

DETAILED DESCRIPTION

Figure 1A:
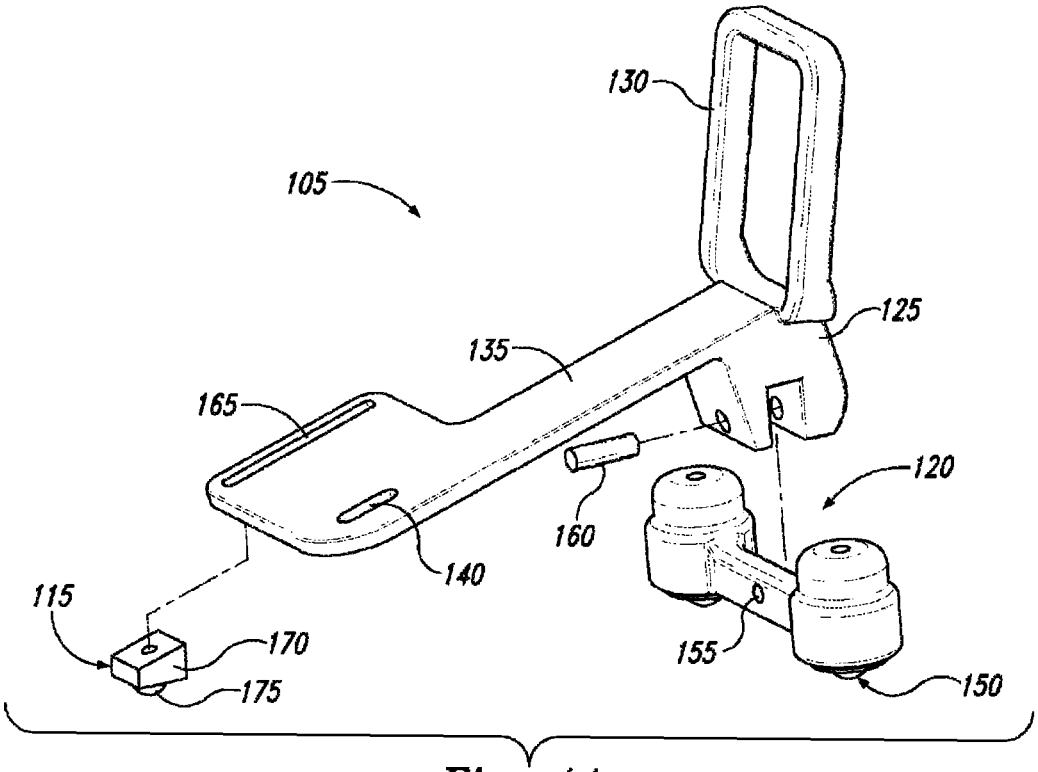
FIGS. 1A and 1B illustrate one example of a support accessory for a hand tool.
Figure 1B:
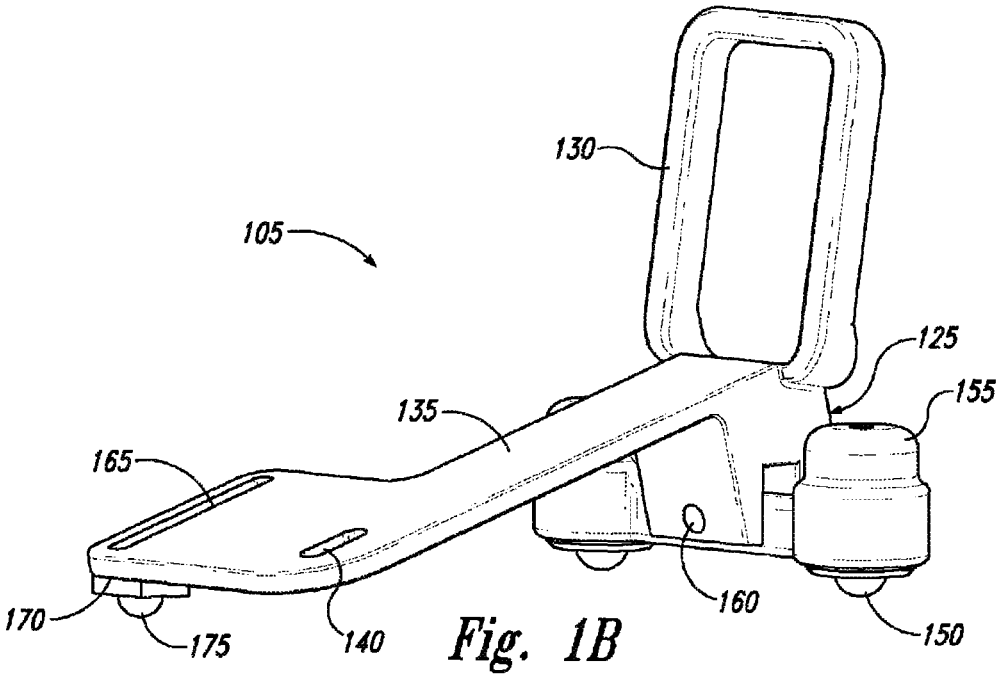
Figure 2A:
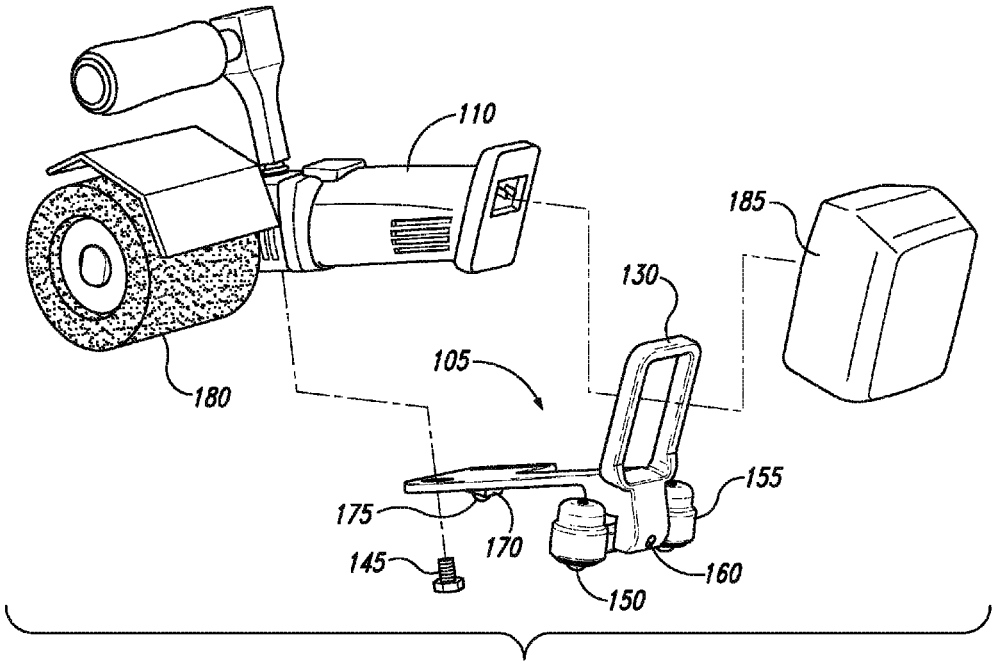
FIGS. 2A and 2B illustrate the support accessory shown in FIGS. 1A and 1B, together with a hand tool.
Figure 2B:
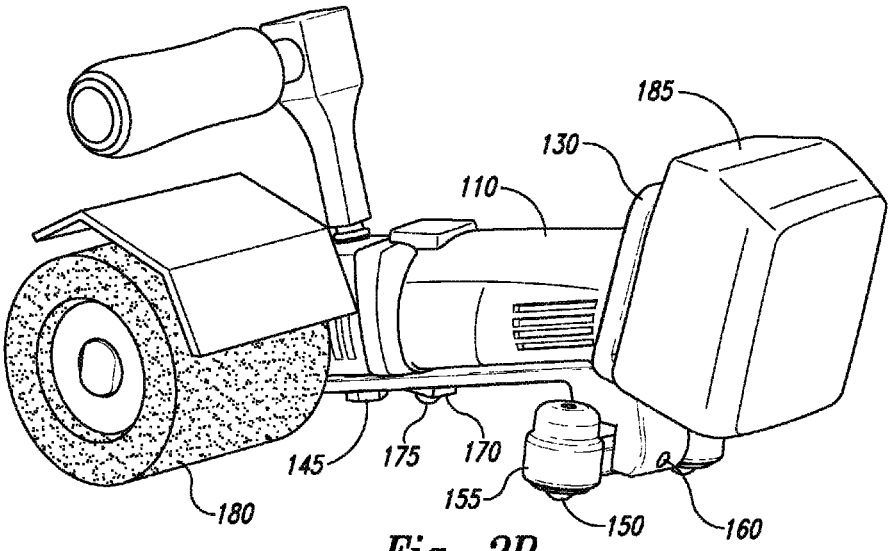

FIGS. 1 and 2 illustrate one example of a support accessory 105 for a hand tool 110. In the illustrated example, the support accessory 105 comprises a front foot assembly 115 and a back foot assembly 120 detachably coupled to a frame 125. The frame 125 comprises a base sleeve 130 configured to receive a portion of the tool 110 therein to couple at least a portion of the tool 110 to the support accessory 105. The frame 125 also comprises a longitudinal beam 135 extending forward from the base sleeve 130, on which the body of the tool 110 rests during use. The frame 125 further comprises an opening 140 through which the support accessory 105 may be attached to the tool 110 by a fastener 145 at a standard attachment point. When the support accessory 105 is not in use, the fastener 145 may be used to attach other accessories, such as shields, handles, etc., to the tool 110 at the attachment point. The frame 125 may comprise any suitable material that is sufficiently robust to support the tool 110, such as, for example, glass-filled nylon.

In the example shown in FIGS. 1 and 2, the hand tool 110 comprises a grinder with a rotating brush 180 and a removable battery 185, such as, for example the POLY-PTX® grinder manufactured by Gerd Eisenblätter GmbH located in Geretsried, Germany. In other examples, the hand tool 110 may comprise a wide variety of other suitable tools, such as, for example, a polisher, saw, drill, etc. In operation, the support accessory 105 is secured to the tool 110 by the base sleeve 130 and the fastener 145, and is configured to support the weight of the tool 110, such that the tool operator does not need to support the weight of the tool 110 tool during use. As shown in FIG. 2, the base sleeve 130 may be configured to enable the battery 185 to be removed and replaced without removing the tool 110 from the support accessory 105.

During use, an operator moves the tool 110 and the support accessory 105 over the surface of a workpiece (not shown), such as a component of a vehicle, while the support accessory 105 holds the weight of the tool 110. The support frame 105 is preferably configured to support the tool 110 both front-to-back and side-to-side. In addition, the support frame 105 is preferably configured to keep the tool 110 parallel to the surface of the workpiece and to enable the operator to maintain even pressure as the tool 110 moves across the surface of the workpiece.

In the example shown in FIGS. 1 and 2, the back foot assembly 120 comprises two back feet 150 coupled to a trunnion 155, which in turn is coupled to the frame 125 by an axle 160. This configuration enables the trunnion 155 to pivot with respect to the frame 125 during use. In some cases, the trunnion 155 is configured to rotate slightly (e.g., about 5-10 degrees each way), to stabilize the tool 110 side-to-side and to enable the tool 110 to remain parallel to a workpiece that may have a contoured or irregular surface.

The front foot assembly 115 comprises a front foot 175 coupled to a front foot housing 170, which is in turn coupled to the frame 125 in a slot 165 located near a front end of the longitudinal beam 135. As shown in FIGS. 1 and 2, the front foot assembly 115 may be slightly offset (i.e., cantilevered) from the longitudinal beam 135 to support the weight of components (e.g., motors, gearing, etc.) that may be positioned near one side of the tool 110. As a result, the position of the front foot assembly 115 can advantageously stabilize the tool 110 front-to-back and enable the tool 110 to remain parallel to the surface of the workpiece. In some cases, the front foot assembly 115 is coupled to the frame 125 with a suitable fastener, such as a jack screw (not shown). In such cases, the slot 165 acts as a height adjusting device that enables an operator to adjust the angle of the tool 110 on the support accessory 105, as desired, by adjusting the attachment point of the front foot assembly 115 within the slot 165.

In the illustrated example, the front foot 175 and back feet 150 comprise conventional, replaceable nylon ball transfers, such as, for example, LP15 plastic range Omnitrack ball units manufactured by Omnitrack, Ltd. located in Woodchester, United Kingdom. In this example, the nylon ball transfers may snap into place in corresponding pockets in the front foot housing 170 and trunnion 155, respectively, which may include access holes to allow a worn ball transfer to be removed and replaced easily. In operation, the nylon balls may allow the support accessory 105 to slide or roll easily across the workpiece. In other examples, the front foot 175 and back feet 150 may comprise low-friction pads (e.g., Teflon®) or any other suitable low-friction structures or material that enable the support accessory to move across the surface of the workpiece without scratching or otherwise damaging the surface.

The support accessory 105 can advantageously stabilize an otherwise heavy and cumbersome hand tool 110, and keep it true to the surface of a workpiece. As a result, the tool operator can simply set the tool 110 on the workpiece and guide it around the surface as desired, without having to hold up the weight of the tool 110. Accordingly, the support accessory 105 advantageously improves the ergonomics of the tool 110, thereby reducing operator strain and increasing productivity and efficiency.

FIGS. 1 and 2 illustrate only one particular example of a support accessory 105 for a hand tool 110. Many other variations and alternative configurations will become apparent to those of skill in the art, having the benefit of this disclosure. For example, in some cases, the support accessory 105 may have only one back foot 150, two or more front feet 175, and/or additional or alternative support structures located elsewhere on the frame 125. As another example, the support accessory 105 may include numerous additional or alternative components, such as fasteners, joints, etc. Additionally, the frame 125 of the support accessory 105 may be configured to attach to a hand tool 110 at additional and/or alternative locations, and may be designed to accommodate a variety of hand tools 110 or customized to fit a particular tool 110. In some cases, the support accessory 105 may be designed to be permanently attached to a tool 110 or may even be integrated into the housing of the tool 110 itself. Numerous additional variations and alternatives are possible, as will be appreciated by those of ordinary skill in the art.

Figure 3:
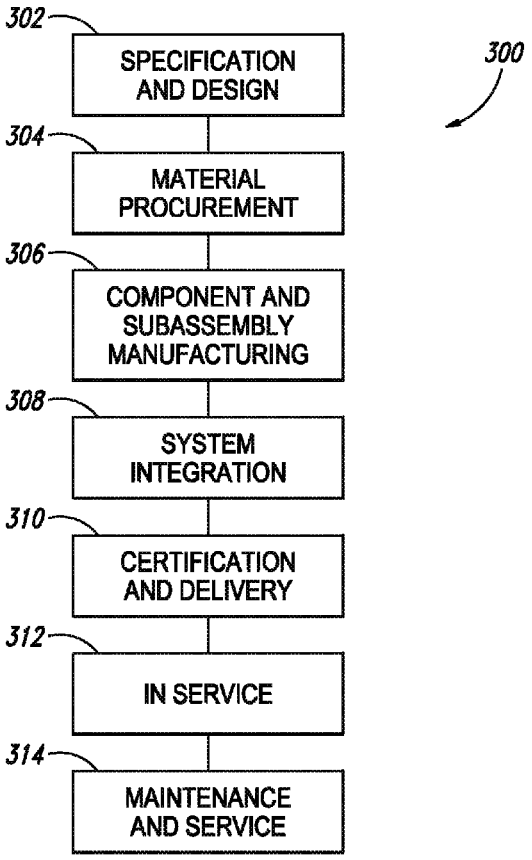
FIG. 3 illustrates a flow diagram of an aircraft production and service methodology.
Figure 4:
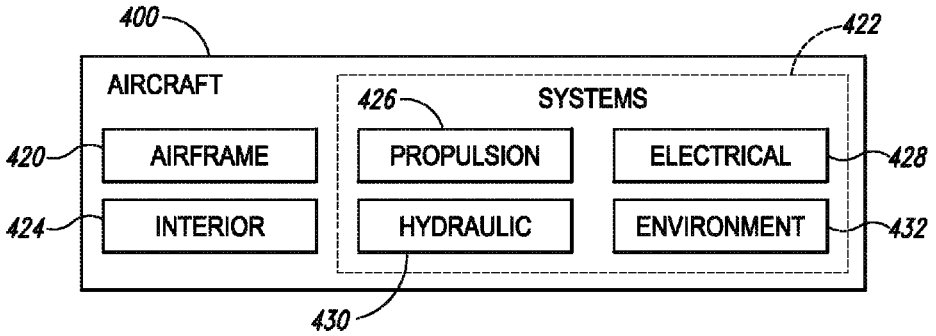
FIG. 4 illustrates a block diagram of an aircraft.

Referring to FIGS. 3-4, the systems and methods of the present application may be implemented in the context of an aircraft manufacturing and service method 300 as shown in FIG. 3 and an aircraft 400 as shown in FIG. 4. During pre-production, exemplary method 300 may include specification and design 302 of the aircraft 400 and material procurement 304. During production, component and subassembly manufacturing 306 and system integration 308 of the aircraft 400 takes place. Thereafter, the aircraft 400 may go through certification and delivery 310 in order to be placed in service 312. While in service 312 by a customer, the aircraft 400 is scheduled for routine maintenance and service 314 (which may also include modification, reconfiguration, refurbishment, and so on).

Each of the processes of method 300 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 4, the aircraft 400 produced by exemplary method 300 may include an airframe 420 with a plurality of systems 422 and an interior 424. Examples of high-level systems 422 include one or more of a propulsion system 426, an electrical system 428, a hydraulic system 426, and an environmental system 428. Any number of other systems may be included. Although an aerospace example is shown, the principles of the disclosed embodiments may be applied to other industries, such as the automotive industry.

Apparatus and methods embodied herein may be employed during any one or more of the stages of the production and service method 300. For example, components or subassemblies corresponding to production process 306 may be fabricated or manufactured in a manner similar to components or subassemblies produced while the aircraft 400 is in service 312. Also, one or more apparatus embodiments, method embodiments, or a combination thereof may be utilized during the production stages 306 and 308, for example, by substantially expediting assembly of or reducing the cost of an aircraft 400. Similarly, one or more of apparatus embodiments, method embodiments, or a combination thereof may be utilized while the aircraft 400 is in service 312, for example and without limitation, to maintenance and service 314.

Although this disclosure has been described in terms of certain preferred configurations, other configurations that are apparent to those of ordinary skill in the art, including configurations that do not provide all of the features and advantages set forth herein, are also within the scope of this disclosure. Accordingly, the scope of the present disclosure is defined only by reference to the appended claims and equivalents thereof.

What is claimed is:

1. A support accessory comprising:

a frame with a longitudinal beam configured to stabilize a hand tool front-to-back when the hand tool is detachably fastened to the frame;

a back foot assembly including a trunnion rotatably coupled to the frame and configured to stabilize the hand tool side-to-side when the hand tool is fastened to the frame, the trunnion having a pivot axis vertically aligned with a longitudinal centerline of the longitudinal beam to enable the hand tool to rotate side-to-side while stabilized; and a front foot in a housing detachably coupled to the frame, wherein the hand tool is supported in a position that is substantially parallel to a surface of a workpiece when the hand tool is fastened to the frame.

2. The support accessory of claim 1, wherein the hand tool comprises a grinder or polisher.

3. The support accessory of claim 1, further comprising: two or more back feet detachably coupled to the trunnion.

4. The support accessory of claim 1, wherein the front foot is laterally offset from the longitudinal beam.

5. The support accessory of claim 1, wherein the front foot is detachably coupled to the frame in a slot that enables an operator to adjust the height of the hand tool.

6. The support accessory of claim 3, wherein the front foot and back feet each comprises a removable nylon ball or a low-friction pad.

7. The support accessory of claim 1, further comprising a base sleeve configured to wrap around a base of the hand tool.

8. The support accessory of claim 7, wherein the base sleeve is configured to enable access for removal and replacement of a tool battery, without detaching the hand tool from the frame.

9. The support accessory of claim 1, wherein the frame includes an opening through which the frame may be attached to the hand tool by a fastener.

10. The support accessory of claim 1, wherein the frame comprises glass-filled nylon.

11. The support accessory of claim 1, wherein the trunnion is configured to rotate by less than about 5-10 degrees with respect to the frame.

12. A system comprising:

a hand tool; and a support accessory detachably fastened to the hand tool, the support accessory comprising:

a frame with a longitudinal beam configured to stabilize the hand tool front-to-back; and a back foot assembly including a trunnion rotatably coupled to the frame and configured to stabilize the hand tool side-to-side, the trunnion having a pivot axis vertically aligned with a longitudinal centerline of the longitudinal beam;

a front foot in a housing detachably coupled to the frame, wherein the support accessory is configured to support the hand tool in a position that is substantially parallel to a surface of a workpiece.

13. The system of claim 12, wherein the hand tool comprises a grinder or polisher.

14. The system of claim 12, wherein the support accessory further comprises:

two or more back feet detachably coupled to the trunnion.

15. The system of claim 12, wherein the support accessory further comprises a base sleeve configured to wrap around a base of the hand tool.

16. The system of claim 12, wherein the frame includes an opening through which the support accessory may be attached to the hand tool by a fastener.

17. The support accessory of claim 12, wherein the trunnion is configured to rotate by less than about 5-10 degrees with respect to the frame.

18. A method comprising:

placing a support accessory and a hand tool detachably fastened to the support accessory on a surface of a workpiece; and guiding the hand tool over the surface of the workpiece, while the hand tool is stabilized front-to-back and side-to-side by the support accessory and is supported in a position that is substantially parallel to the surface of the workpiece, wherein during the guiding the hand tool is stabilized side-to-side by a back foot assembly of the support including a trunnion rotatably coupled to a frame of the support accessory, the trunnion having a pivot axis vertically aligned with a longitudinal centerline of a longitudinal beam of the frame, wherein during the guiding, the hand tool is stabilized front-to-back by a front foot in a housing detachably coupled to the frame.

19. The method of claim 18, wherein the hand tool comprises a grinder or polisher.

20. The method of claim 18, wherein the surface of the workpiece is contoured or irregular.

* * * * *